US008052367B2

(12) United States Patent
Heyn

(10) Patent No.: US 8,052,367 B2
(45) Date of Patent: Nov. 8, 2011

(54) ANGLED SEALING SURFACE FOR CONTAINER END PANEL

(76) Inventor: William M. Heyn, New Canaan, CT (US)

( * ) Notice: Subject to any disclaimer, the term of this patent is extended or adjusted under 35 U.S.C. 154(b) by 971 days.

(21) Appl. No.: 10/586,723

(22) PCT Filed: Jan. 18, 2005

(86) PCT No.: PCT/US2005/001200
§ 371 (c)(1),
(2), (4) Date: Jul. 17, 2006

(87) PCT Pub. No.: WO2005/070585
PCT Pub. Date: Aug. 4, 2005

(65) Prior Publication Data
US 2008/0253863 A1 Oct. 16, 2008

(51) Int. Cl.
*B21D 51/30* (2006.01)
*B21D 51/44* (2006.01)

(52) U.S. Cl. ..... 413/4; 413/8; 413/12

(58) Field of Classification Search ..... 413/4, 5, 413/7–9, 12, 27, 58, 59, 62; 53/487; 72/379.4
See application file for complete search history.

(56) References Cited

U.S. PATENT DOCUMENTS 1,866,469 A * 7/1932 Hirsch et al. ..... 413/12
3,212,468 A * 10/1965 Rychiger ..... 413/4
5,156,511 A * 10/1992 De Smet ..... 413/8

* cited by examiner

*Primary Examiner* — Debra Sullivan
(74) *Attorney, Agent, or Firm* — William H. Holt

(57) ABSTRACT

End panel (36) has its periphery (38) affixed to a flange portion (34) of container ring member (30) disposed in a planar position, and the flange portion (34) is then displaced from the plane for forming an angle (A) therewith. The method results in placing the interface between the end panel (36) and the flange portion (34) in sheer, rather than in peel, during retorting or unintentional impact loading.

7 Claims, 1 Drawing Sheet

ANGLED SEALING SURFACE FOR CONTAINER END PANEL

This invention relates to a new method for providing an improved closure for a container of the type used for food products and the like.

BACKGROUND OF THE INVENTION

It is known to provide a container with an annular ring affixed to a top portion of the container and provide a foil or film or thin plastic closure member affixed along its periphery to the ring member either by adhesive, or heat sealing, or the like. It is also known from U.S. Pat. No. 5,725,120 that the ring member can have a flange portion thereof bent upwardly and outwardly from the container thereby allowing for the end panel to be secured to the flange portion of the ring member so that the seal therebetween is placed in shear, rather than peel, during a subsequent retort operation. A shortcoming with this known method is that the end panel, formed of foil, or film, or thin plastic material, becomes wrinkled during application of the end panel to the flange portion of the ring. This fault is likely to allow for leaks to develop during retorting or the subsequent shelf life of the container.

SUMMARY OF THE INVENTION

The invention comprises a novel method for applying an end panel to a closure ring for a container wherein the closure ring includes an inwardly directed annular flange portion having a central opening for filling and emptying an associated container. The flange portion is initially disposed in a plane in a planar configuration, and the method includes the step of securing a peripheral portion of an end panel for the container to the planar disposed flange portion, as is known in the prior art. The method includes the improved step of displacing the flange portion, with the end panel secured thereto, from the plane to an angle thereto for forming a frusto-conical angle with the plane prior to a further step of securing the ring member and end panel to a container for closing the same.

DETAILED DESCRIPTION OF THE PREFERRED EMBODIMENT

Figure 1:
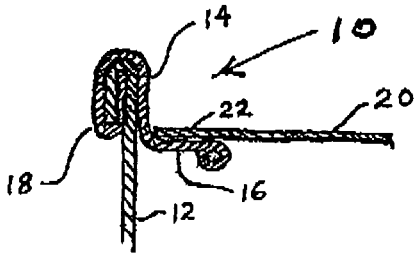
FIG.1 (Prior Art)
FIG. 1 shows a fragmentary portion of a container body having an annular ring member double seamed to the upper rim thereof, the ring member having an inwardly directed annular flange disposed horizontally and having an end panel sealed thereto for closing the container.

FIG. 1 illustrated a prior art combination, generally indicated by the numeral 10, including a container wall 12 having an annular metal ring 14 having an inwardly directed flange portion 16, with the ring member 14 attached to the container wall 12 with a conventional double seam 18. An end panel 20, which may be foil, film, or thin plastic has its peripheral portion 22 sealed to flange portion 16. Product may be removed from the container 12 by rupturing the end panel 20 or peeling it to remove it from flange portion 16. If the container combination 10 contains product that needs to be treated by a retort operation, it is known that the end panel 20 bulges upwardly and initiates a peeling operation so that the end panel can become detached from the flange portion 16. Such a result is undesirable.

Figure 2:
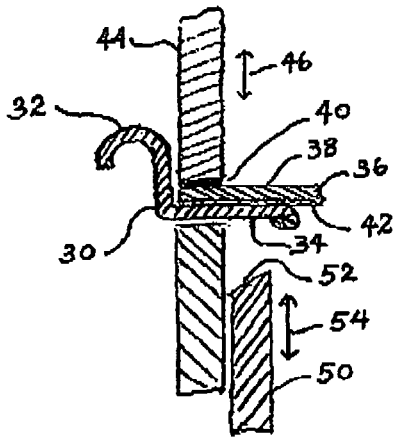
FIG. 2 shows a fragmentary portion of an annular ring member having an overlying end panel disposed within a an annular tool for heat sealing the end panel to the flange portion of the ring member and an upwardly movable chuck member for engaging the flange portion and bending the flange portion and end panel upwardly.

FIG. 2 illustrates a first step in the method providing for the present invention and illustrates an annular ring member 30 having a hook portion 32 which is used for subsequent double seaming of the ring member to an associated container. An end panel 36, formed of foil, or film, or thin plastic, has its peripheral portion 38 overlying flange portion 34 and the members being placed within an annular clamping tool 44 having a heated portion 40 for heat sealing the end panel to the flange portion of ring member 30. Clamping tool 44 is movable as depicted by arrow 46. En one form of the invention, a thin layer or film of adhesive 42 is provided on the underside of end panel 36. This material could likewise be placed upon the upper surface of flange portion 34.

Subsequent to or coincident with the heat sealing, an annular chuck 50, having an angled upper surface 52, is moved upwardly into engagement with flange portion 34 as depicted by arrow 54.

Figure 3:
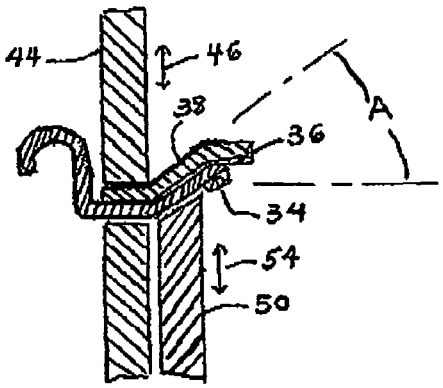
FIG. 3 shows the chuck member having completed the step of bending the flange portion and end panel thereby completing the forming operation.
Figure 4:
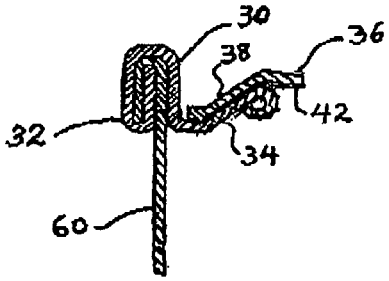
FIG. 4 shows the ring member and end panel of FIG. 3 after being double-seamed to the upper rim of a container wall.

As is best shown in FIG. 3, chuck member 50 has bent flange portion 34 and peripheral portion 38 of end panel 36 upwardly to form an angle A, the angle being in a range of 5° to 45°, with a preferred angle being approximately 25°.

Following completion of the method steps depicted in FIG. 3, the ring member 30 has its hook portion 32 double seamed to the upper rim of a container wall 60.

Figure 5:
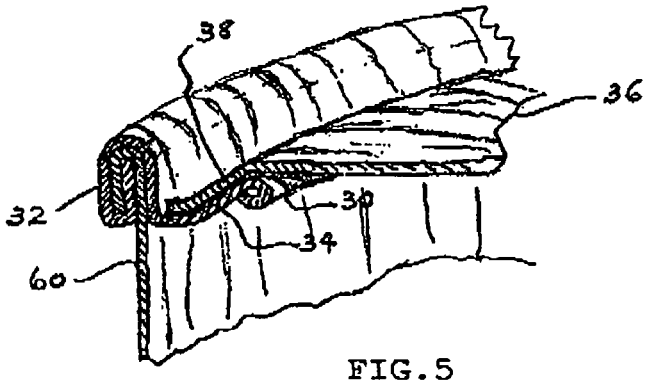
FIG. 5 is a fragmentary, perspective view of the assembled container, annular ring member and end panel being secured thereto.

FIG. 5 is a fragmentary perspective view showing the container body 60 having affixed thereto the ring member 30 and the peripheral portion 38 of end panel 36. A consideration of FIG. 5 will make it clear that end panel 36 may bulge or be distorted upwardly during a retort operation but with the desirable result that peripheral portion 38 and flange portion 34 are retained in shear, rather than peel, by protecting against inadvertent separation of the end panel from the ring member.

In view of the foregoing, it will be seen that a novel method has been provided for attaching an end panel to an annular ring for a container, but it should be understood that the foregoing description is by way of illustration and the invention is not necessarily limited thereto. Modifications and variations will be apparent from the disclosure and may be resorted to without departing from the spirit of the invention as those of skill in the art will readily understand. Accordingly, such variations and modifications are considered to be within the purview and scope of the invention as defined in the following claimed subject matter.

The invention claimed is:

1. A method for applying an end panel to a closure ring for a container, wherein said closure ring includes an inwardly directed annular flange portion having a central opening for filling and emptying an associated container, said flange portion being initially disposed in a plane in a planar configuration, said method including a step of securing a peripheral portion of a peelable end panel for a container to said planar disposed flange portion, said method further comprising a step of displacing said flange portion, with said end panel secured thereto, from said plane to an angle thereto for forming an acute angle with said plane prior to securing said ring member and end panel to a container, whereby said end panel is maintained in shear with said annular flange portion and is peelable therefrom.

2. A method as defined in claim 1 including the step of forming said angle within a range between 5 and 45 degrees.

3. A method as defined in claim 2 including the step of forming said angle to be approximately 25 degrees.

4. A method as defined in claim 1 wherein the step of securing said end panel to said flange portion includes the step of heat sealing said flange portion to said peripheral portion of said end panel.

5. A method as defined in claim 4 including a step of applying a layer of adhesive material to said peripheral portion of said end panel for sealing said peripheral portion to said flange portion.

6. A method as defined in claim 5 wherein said end panel is formed of foil.

7. A method as defined in claim 5 wherein said end panel is formed of thermoplastic material.

* * * * *